US009380368B2

(12) United States Patent
Chiang

(10) Patent No.: US 9,380,368 B2
(45) Date of Patent: Jun. 28, 2016

(54) MICROPHONE FIXING DEVICE

(71) Applicant: MASCOT ELECTRIC CO., LTD., Tainan (TW)

(72) Inventor: Kun-Tien Chiang, Tainan (TW)

(73) Assignee: MASCOT ELECTRIC CO., LTD., Tainan (TW)

( * ) Notice: Subject to any disclaimer, the term of this patent is extended or adjusted under 35 U.S.C. 154(b) by 13 days.

(21) Appl. No.: 14/312,376

(22) Filed: Jun. 23, 2014

(65) Prior Publication Data

US 2015/0373437 A1 Dec. 24, 2015

(51) Int. Cl.
*H04R 1/08* (2006.01)

(52) U.S. Cl.
CPC ..... *H04R 1/08* (2013.01)

(58) Field of Classification Search
CPC ..... H04R 1/083; H04R 3/005; H04R 1/08; H04R 19/04; H04R 1/086; H04R 19/005; H04R 2499/11; H04R 2499/13
USPC ..... 381/91
See application file for complete search history.

(56) References Cited

U.S. PATENT DOCUMENTS 4,194,096 A * 3/1980 Ramsey ..... H04R 1/08 381/363
4,546,950 A * 10/1985 Cech ..... F16F 1/46 211/60.1
6,459,802 B1 * 10/2002 Young ..... H04R 1/083 381/361
6,922,475 B2 * 7/2005 Hsieh ..... H04R 1/08 381/361

* cited by examiner

*Primary Examiner* — Mark Blouin
(74) *Attorney, Agent, or Firm* — Kirton McConkie; Evan R. Witt

(57) ABSTRACT

A microphone fixing device is adapted for fixing a microphone to a sound-producing object. The microphone includes a head and a cable electrically connected to the head. The microphone fixing device includes a fixing unit, a buffer seat and a supporting seat. The fixing unit is adapted to be mounted to the sound-producing object, and is formed with at least one cable groove that is adapted for retaining a portion of the cable of the microphone. The buffer seat is mounted on the fixing unit, is spaced apart from the at least one cable groove, and includes at least one resilient wall. The supporting seat is removably mounted on the resilient wall of the buffer seat, and is adapted for supporting the head of the microphone thereon.

5 Claims, 4 Drawing Sheets

MICROPHONE FIXING DEVICE

BACKGROUND OF THE INVENTION

1. Field of the Invention

The invention relates to a fixing device, more particularly to a microphone fixing device adapted for fixing a microphone to a sound-producing object.

2. Description of the Related Art

A microphone, when being used, can be hand-held, mounted on a support frame, or mounted by a conventional microphone fixing device (such as a pair of clamps) to a sound-producing object (such as an instrument).

However, even though sound pickup and amplification are achieved when the microphone is mounted to the sound-producing object with the conventional microphone fixing device, there are still many factors that affect sound quality: environmental noise, vibration of the sound-producing object, displacement of a cable connected electrically to the microphone, etc. The conventional microphone fixing device generally lacks vibration-absorbing abilities, causing the microphone to pick up any sound variation caused by vibrations generated from the sound-producing object, thus affecting sound quality. Moreover, the conventional microphone fixing device is generally not capable of securing the cable in place, such that during use, movement of the cable is bound to affect the stability of sound transmission.

SUMMARY OF THE INVENTION

Therefore, the object of the present invention is to provide a microphone fixing device that can eliminate at least one of the aforesaid drawbacks of the prior art.

According to the present invention, there is provided a microphone fixing device adapted for fixing a microphone to a sound-producing object. The microphone includes a head and a cable that is electrically connected to the head. The microphone fixing device includes a fixing unit, a buffer seat and a supporting seat. The fixing unit is adapted to be mounted to the sound-producing object, and is formed with at least one cable groove that is adapted for retaining a portion of the cable of the microphone. The buffer seat is mounted on the fixing unit, is spaced apart from the at least one cable groove, and includes at least one resilient wall. The supporting seat is removably mounted on the resilient wall of the buffer seat, and is adapted for supporting the head of the microphone thereon.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
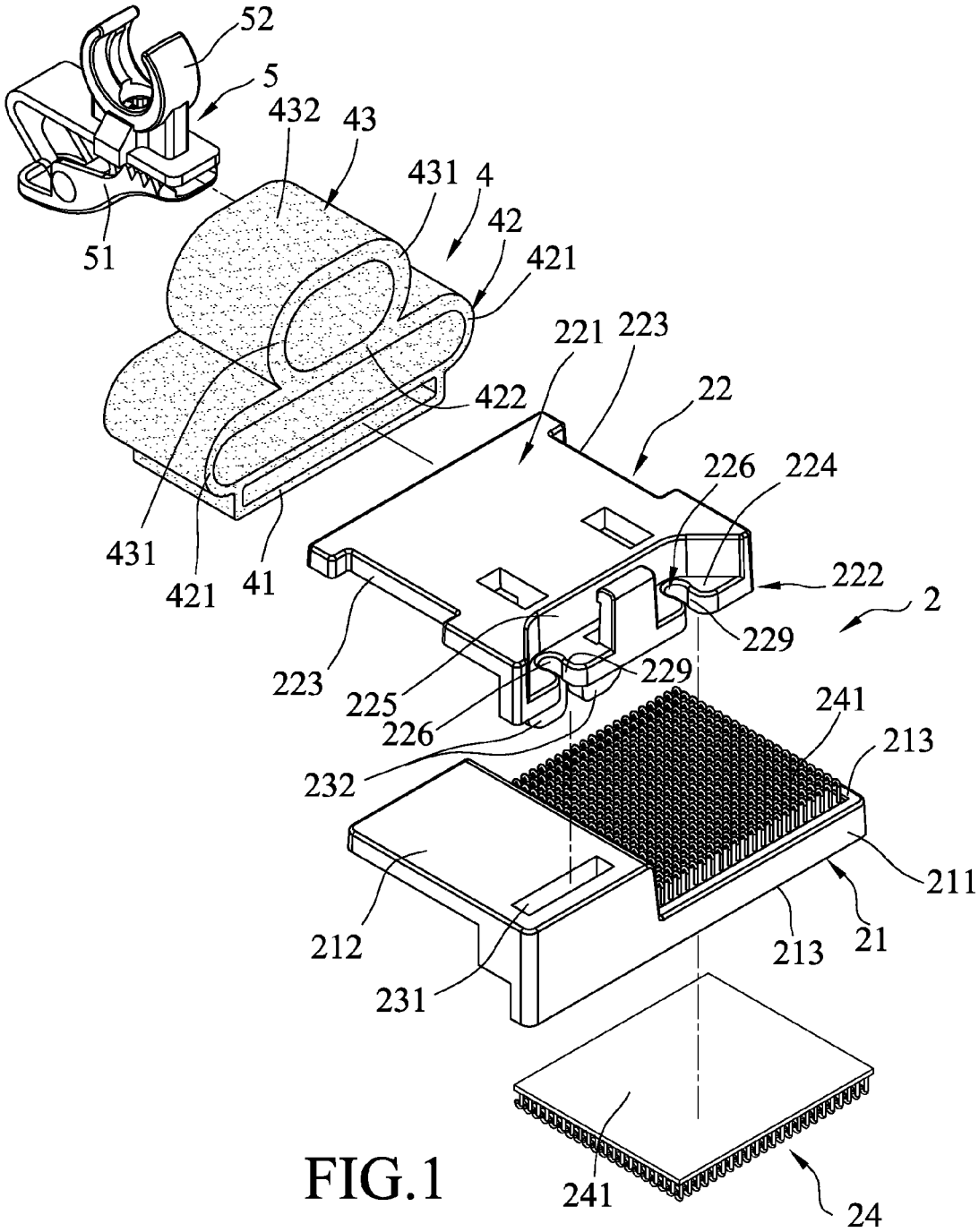
FIG. 1 is an exploded perspective view of a preferred embodiment of a microphone fixing device according to the present invention.
Figure 2:
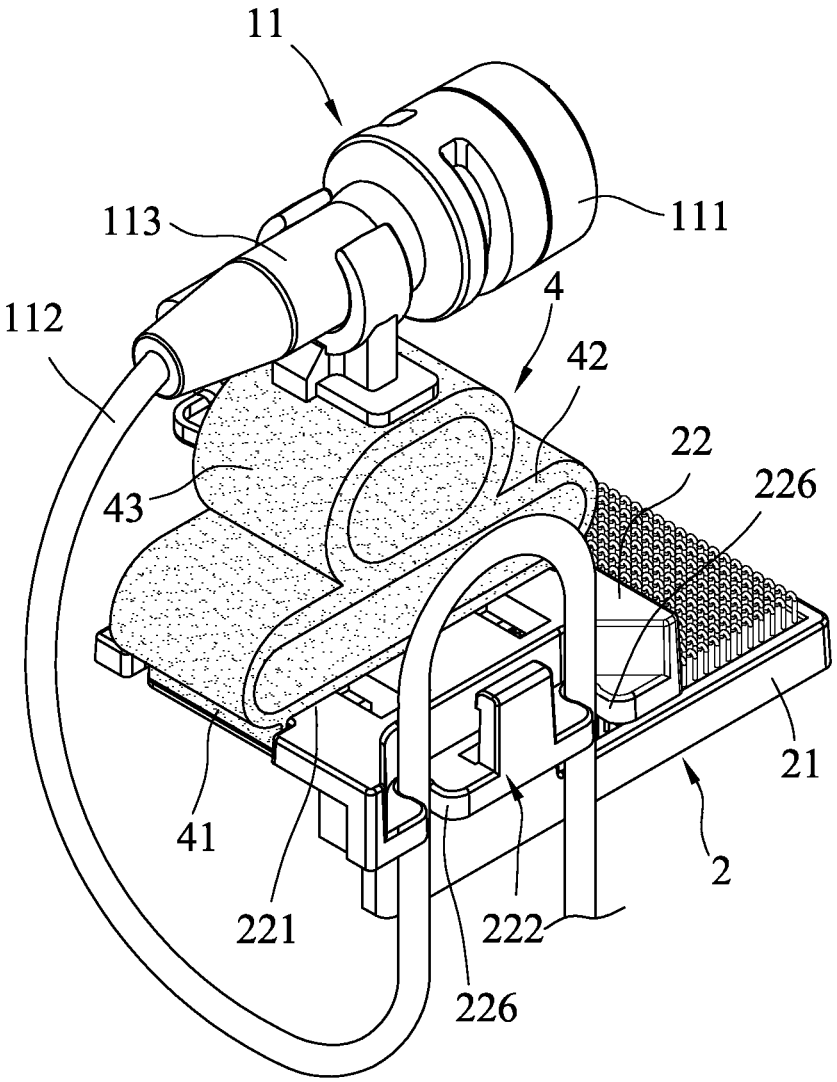
FIG. 2 is an assembled perspective view of the preferred embodiment in use.
Figure 3:
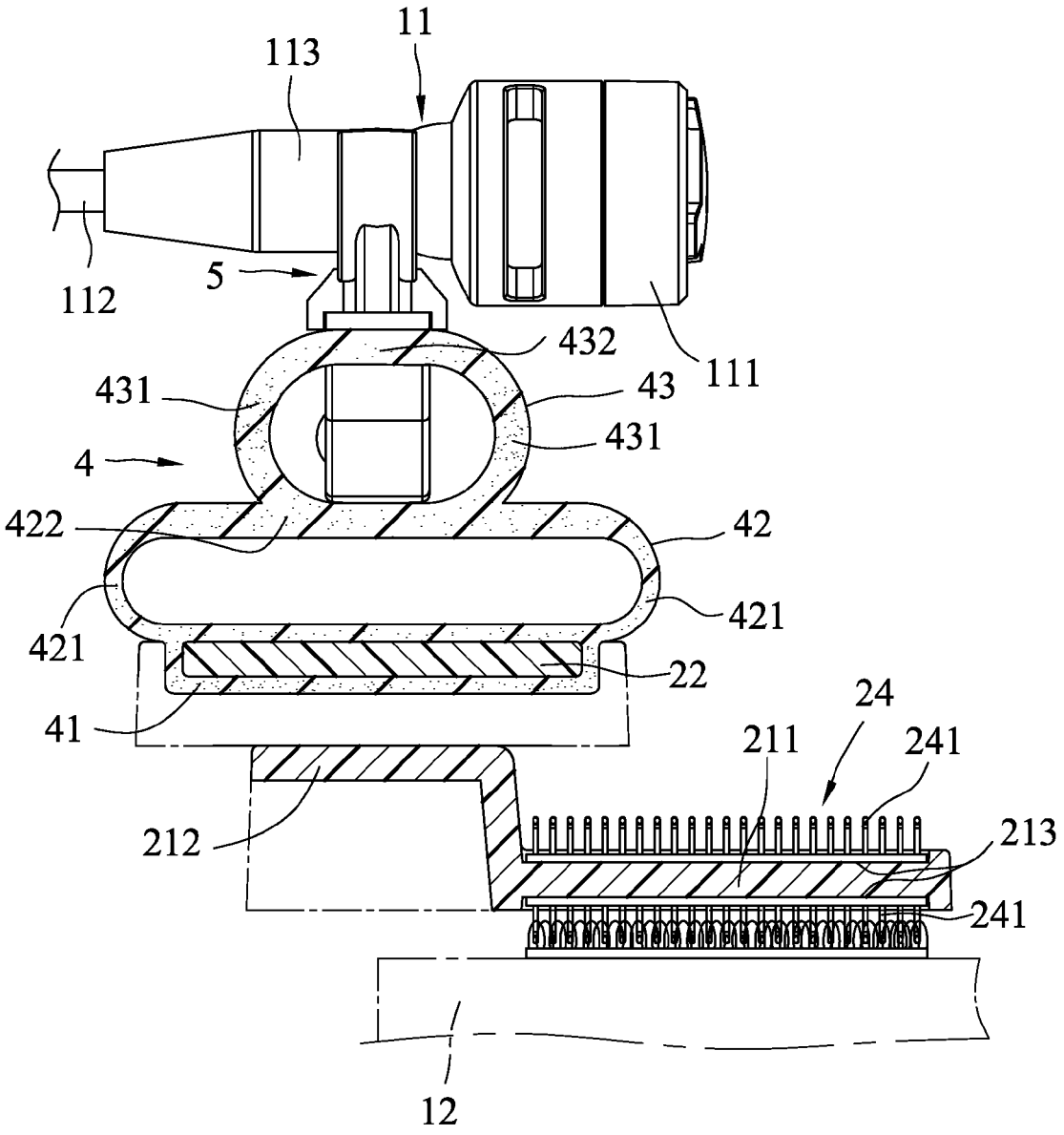
FIG. 3 is a schematic sectional view of the preferred embodiment in use.
Figure 4:
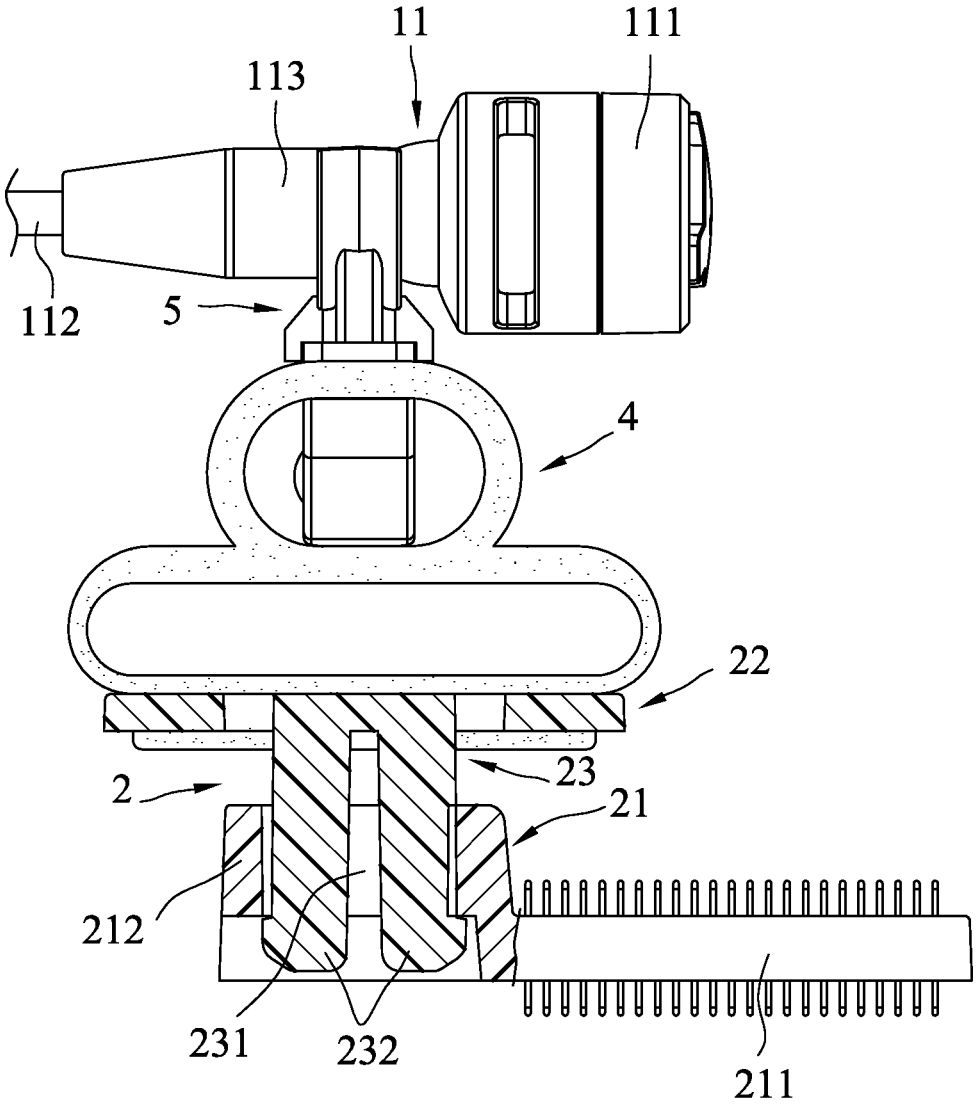
FIG. 4 is a partly sectional view of the preferred embodiment for illustrating a fastening unit and a coupling mechanism of a fixing unit.

Referring to FIGS. 1 to 4, a preferred embodiment of a microphone fixing device according to the present invention is adapted for fixing a microphone 11 to a sound-producing object 12. The microphone 11 includes a head 111 having a rod-shaped portion 113, and a cable 112 electrically connected to the head 111. The microphone fixing device includes a fixing unit 2, a buffer seat 4 and a supporting seat 5.

The fixing unit 2 is adapted to be mounted to the sound-producing object 12, and includes a fixing seat 21, a connecting seat 22, a coupling mechanism 23 for removably connecting the connecting seat 22 to the fixing seat 21, and a fastening unit 24 disposed on the fixing seat 21 and adapted for securing the fixing seat 21 to the sound-producing object 12. The fixing seat 21 includes a rectangular wall 211, and a mounting wall 212 that is connected to and disposed higher than the rectangular wall 211. The rectangular wall 211 has two opposite attaching surfaces 213. The fastening unit 24 has two fastening members 241, each of which is mounted to a respective attaching surface 213. One of the fastening members 241 is used to secure the fixing seat 21 to the sound-producing object 12. In this embodiment, the securing of the fixing seat 21 to the sound-producing object 12 is achieved via hook-and-loop fasteners. For example, each of the fastening members 241 may be a hook fastener, while a loop fastener is provided to the sound-producing object 12, or vice versa. It should be noted that the configuration of the fastening unit 24 is not limited to what is disclosed herein.

The connecting seat 22 has a buffer portion 221 disposed on the mounting wall 212 of the fixing seat 21, and a cable-holding portion 222 integrally formed on a lateral side of the buffer portion 221. The buffer portion 221 has a plate body that is formed with two recesses 223 at opposite sides of the cable-holding portion 222. In this embodiment, the cable-holding portion 222 includes a retaining wall 225 that extends transversely from the lateral side of the plate body of the buffer portion 221, and a clamping wall 224 that extends from the retaining wall 225 and in parallel to the plate body of the buffer portion 221, and that is formed with two spaced-apart cable grooves 226 adapted for retaining a portion of the cable 112 of the microphone 11. Each of the cable grooves 226 has an opening 229 in the distal edge of the clamping wall 224 for insertion of the corresponding portion of the cable 112 therethrough, and the opening 229 has a width that is slightly smaller than that of the cable 112 so as to secure the portion of the cable 112 in the cable groove 226.

The coupling mechanism 23 has an insert slot 231 that is formed in the mounting wall 212 of the fixing seat 21, and two hooks 232 that extend downward from the buffer portion 221 of the connecting seat 22 and that engage removably the insert slot 231. In practice, there may be only one hook 232, and the locations of the hooks 232 and the insert slot 231 may vary. Alternatively, the fixing seat 21 may be intergrally formed with the connecting seat 22, in which case the coupling mechanism 23 is dispensed with.

The buffer seat 4 is mounted on the fixing unit 2 and is spaced apart from the cable grooves 226. The buffer seat 4 is made of a soft, resilient material, and includes a fixing frame 41, a first resilient wall 42 and a second resilient wall 43. The fixing frame 41 is mounted on the buffer portion 221 of the connecting seat 22 of the fixing unit 2. Specifically, the fixing frame 41 is sleeved removably onto the plate body of the buffer portion 221 and engages the recesses 223 of the connecting seat 22. The first resilient wall 42 is integrally connected to a top end of the fixing frame 41. The second resilient wall 43 is integrally connected to a top end of the first resilient wall 42. In other words, the first resilient wall 42 interconnects the fixing frame 41 and the second resilient wall 43. The first resilient wall 42 has two first connecting portions 421 and a first intermediate portion 422. The first connecting portions 421 are spaced apart from each other and are connected to the fixing frame 41 at bottom ends thereof. The first intermediate portion 422 interconnects top ends of the first connecting portions 421. The second resilient wall 43 has two second connecting portions 431 and a second intermediate portion 432. The second connecting portions 431 are spaced apart from each other and are connected to the first intermediate portion 422 of the first resilient wall 42 at bottom ends thereof. The second intermediate portion 432 interconnects top ends of the second connecting portions 431.

The supporting seat 5 includes a clamping portion 51 and a supporting portion 52. The clamping portion 51 is removably clamped onto the second intermediate portion 432 of the second resilient wall 43 of the buffer seat 4. The supporting portion 52 is connected to the clamping portion 51 and adapted for supporting the rod-shaped portion 113 of the head 111 of the microphone 11.

When in use, one of the fastening members 241 is used to mount the fixing unit 2 to the sound-producing object 12, the fixing frame 41 of the buffer seat 4 is sleeved onto the buffer portion 221 of the connecting seat 22 of the fixing unit 2, and the rod-shaped portion 113 of the head 111 of the microphone 11 is inserted into the supporting portion 52 of the supporting seat 5. Two portions of the cable 112 are then inserted into the cable grooves 226 through the openings 229 so as to keep the cable 112 fixed in place. Finally, the clamping portion 51 is clamped onto the second intermediate portion 432 of the second resilient wall 43 of the buffer seat 4, and the hooks 232 of the coupling mechanism 23 are engaged with and inserted into the insert slot 231 of the coupling mechanism 23.

At this moment, the head 111 of the microphone 11 is proximate to the sound generating area of the sound-producing object 12 and can easily pick up sound at a short distance. Moreover, due to the provision of the buffer seat 4 between the fixing unit 2 and the head 111 of the microphone 11, resonance or vibrations produced by the sound-producing object 12 during use can be absorbed by the buffer seat 4; thus improvement of sound quality is achieved. Furthermore, the cable grooves 226 in the connecting seat 22 prevent displacement of the cable 112 of the microphone 11, which ensures the stability of sound transmission.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A microphone fixing device adapted for fixing a microphone to a sound-producing object, the microphone including a head and a cable that is electrically connected to the head, said microphone fixing device comprising:

a fixing unit adapted to be mounted to the sound-producing object, and formed with at least one cable groove that is adapted for retaining a portion of the cable of the microphone;

a buffer seat mounted on said fixing unit, spaced apart from said at least one cable groove, and including at least one resilient wall; and a supporting seat removably mounted on said resilient wall of said buffer seat, and adapted for supporting the head of the microphone thereon;

wherein said buffer seat includes a fixing frame mounted on said fixing unit, a first resilient wall having two first connecting portions that are spaced apart from each other and that are connected to said fixing frame, and a first intermediate portion that interconnects said first connecting portions, and a second resilient wall having two second connecting portions that are spaced apart from each other and that are connected to said first intermediate portion of said first resilient wall, and a second intermediate portion that interconnects said second connecting portions; and wherein said supporting seat is clamped on said second intermediate portion of said second resilient wall.

2. The microphone fixing device as claimed in claim 1, wherein said fixing unit includes a clamping wall formed with two of said cable grooves that are spaced apart from each other and that are respectively adapted for retaining two portions of the cable, each of said cable grooves having an opening for insertion of a corresponding one of the portions of the cable therethrough, said opening having a width that is slightly smaller than that of the cable.

3. The microphone fixing device as claimed in claim 2, wherein said supporting seat includes a clamping portion for being removably clamped on said second resilient wall, and a supporting portion connected to said clamping portion and adapted for supporting the head of the microphone thereon.

4. The microphone fixing device as claimed in claim 1, wherein said fixing unit further includes:

a fixing seat that is adapted to be mounted to the sound-producing object;

a connecting seat that is formed with said at least one cable groove and that is mounted with said fixing frame; and a coupling mechanism for removably connecting said connecting seat to said fixing seat.

5. The microphone fixing device as claimed in claim 4, wherein said fixing unit further includes a fastening unit disposed on said fixing seat and adapted for securing said fixing seat to the sound-producing object.

* * * * *